US005298678A

United States Patent [19]

Higashi

[11] Patent Number: 5,298,678

[45] Date of Patent: Mar. 29, 1994

[54] MUSICAL TONE WAVEFORM SIGNAL FORMING APPARATUS HAVING PITCH CONTROL MEANS

[75] Inventor: Iwao Higashi, Hamamatsu, Japan

[73] Assignee: Yamaha Corporation, Hamamatsu, Japan

[21] Appl. No.: 656,580

[22] Filed: Feb. 14, 1991

[30] Foreign Application Priority Data

Feb. 14, 1990 [JP] Japan ..... 2-31366

[51] Int. Cl.[5] ..... G10H 5/02

[52] U.S. Cl. ..... 84/659; 84/661; 84/630

[58] Field of Search ..... 84/600-603, 84/608, 622-624, 630, 659, 661, DIG. 9

[56] References Cited

U.S. PATENT DOCUMENTS

| | | | |
|---|---|---|---|
| 4,303,991 | 12/1981 | Moore | 84/ |
| 4,584,701 | 4/1986 | Nakama et al. | 84/DIG. 26 X |
| 4,649,783 | 3/1987 | Strong et al. | 84/622 X |
| 4,655,115 | 4/1987 | Nishimoto | 84/624 |
| 4,785,706 | 11/1988 | Toshifumi | 84/DIG. 9 X |
| 4,919,032 | 4/1990 | Sakashita | 84/653 |
| 4,984,276 | 1/1991 | Smith | 84/630 X |
| 5,113,743 | 5/1992 | Higashi | 84/630 X |
| 5,117,729 | 6/1992 | Kunimoto | 84/660 |
| 5,131,310 | 7/1992 | Kunimoto | 84/660 X |
| 5,136,917 | 8/1992 | Kunimoto | 84/661 X |
| 5,157,214 | 10/1992 | Nakanishi et al. | 84/630 X |

FOREIGN PATENT DOCUMENTS 0248527 4/1987 European Pat. Off. .

*Primary Examiner*—William M. Shoop, Jr.
*Assistant Examiner*—Jeffrey W. Donels
*Attorney, Agent, or Firm*—Graham & James

[57] ABSTRACT

A musical tone waveform signal forming apparatus comprises a waveform signal transmission section, a musical tone control signal input section and a pitch control section. The waveform signal transmission section comprises a plurality of signal transmission units which are connected in cascade one by one and each of which comprises first and second signal lines respectively serving as forward and backward paths of a waveform signal and a node portion for feeding back an output from the first signal line to an input side of the second signal line. At least one of the first and second signal lines serves as a signal delay line. The musical tone control signal input section receives the waveform signal from the waveform signal transmission section and a musical tone control signal for controlling musical tone parameters of a musical tone to be generated to change the waveform signal in accordance with the musical tone control signal and output the changed waveform signal to the waveform signal transmission section. The pitch control section changes delay times of the signal delay lines in accordance with a pitch signal, one of the tone control signal, for controlling a tone pitch of the musical tone to be generated.

6 Claims, 2 Drawing Sheets

MUSICAL TONE WAVEFORM SIGNAL FORMING APPARATUS HAVING PITCH CONTROL MEANS

BACKGROUND OF THE INVENTION

1. Field of the Invention

The present invention relates to a musical tone waveform signal forming apparatus utilized in electronic musical instruments, reverberation apparatuses, toys, and the like and, more particularly, to a musical tone waveform signal forming apparatus for receiving a musical tone control signal for steadily or time-serially controlling musical tone parameters such as a pitch, a tone color, a tone volume, and the like of a musical tone, and forming a musical tone waveform signal according to the input musical tone control signal.

2. Description of the Prior Art

As disclosed in, e.g., Japanese Patent Laid-Open No. Sho 63-40199, a conventional apparatus of this type comprises a waveform signal transmission section constituted by a plurality of signal transmission units which are connected in cascade one by one and each of which comprises a first signal line serving as a forward path of a waveform signal, a second signal line serving as a backward path of the waveform signal, and a node portion for attenuating an output from the first signal line, transmitting the attenuated output to the next stage, and feeding back the output from the first signal line to an input side of the second signal line, at least one of the first and second signal lines serving as a signal delay line., a musical tone control signal input section for receiving a waveform signal from the waveform signal transmission section and a musical tone control signal for controlling musical tone parameters of a musical tone to be generated, changing the waveform signal in accordance with the musical tone control signal, and outputting the changed waveform signal to the waveform signal transmission section., and a pitch control section for changing attenuation coefficients and feedback coefficients of the respective node portions in accordance with a pitch control signal for controlling a pitch of the musical tone control signal. The musical tone control signal input section corresponds to a mouthpiece of a wind instrument, the waveform signal transmission section corresponds to a resonance tube of a wind instrument, and the node portions in the waveform transmission section correspond to tone holes of the wind instrument, so that a musical tone control signal according to performance data is inputted to the musical tone signal input section and the pitch control section, and a waveform signal is generated according to the input musical tone control signal, thereby generating a musical tone imitating a musical tone of the wind instrument, or the like.

More specifically, in the conventional apparatus, pitch control is performed by simulating tone holes of the wind instrument, and the delay times of delay lines corresponding to a flared tubular shape of the wind instrument are set to be constant. Therefore, it is difficult to change a pitch at an interval smaller than that determined by tone hole intervals.

SUMMARY OF THE INVENTION

The present invention has been made in consideration of the above-mentioned conventional problems, and has as its object to provide a musical tone waveform signal forming apparatus which has a simple arrangement, and can attain pitch control of a musical tone at smaller intervals.

In order to achieve the above object, a musical tone waveform signal forming apparatus according to the present invention comprises waveform signal transmission means constituted by a plurality of signal transmission units which are connected in cascade one by one, and each of which comprises a first signal line serving as a forward path of a waveform signal, a second signal line serving as a backward path of said waveform signal, and a node portion for feeding back an output from said first signal line to an input side of said second signal line, at least one of said first and second signal lines serving as a signal delay line; musical tone control signal input means for receiving said waveform signal from said waveform signal transmission means and musical tone control signals for controlling musical tone parameters of a musical tone to be generated, changing the waveform signal in accordance with the musical tone control signals, and outputting the changed waveform signal to said waveform signal transmission means; and pitch control means for changing delay times of said signal delay lines in accordance with a pitch signal, one of said musical tone control signals, for controlling a tone pitch, one of said musical tone parameters.

More specifically, according to the present invention, a pitch of a musical tone is controlled by changing a delay (delay time) corresponding to the length of a tube body, while 'in the prior art' attenuation coefficients and feedback coefficients of node portions are changed to simulate tone holes of the wind instrument.

According to the present invention, each node portion corresponds to a seam of a tube, and a feedback coefficient of each node portion corresponds to a reflection coefficient of a musical tone signal at that seam, i.e., the ratio of the sectional areas of two tubes connected at that seam.

Therefore, when the feedback coefficient of each node portion is set to be constant regardless of a change in delay time, a wind instrument in which the sectional areas of tubes constituting a tube body are constant, and the length of the tube body is telescopically expanded/contracted can be simulated. On the other hand, if a feedback coefficient of each node portion is corrected in correspondence with a change in delay time, a wind instrument in which, for example, a tube body shape is expanded/contracted with a similar shape can be simulated.

Delay times corresponding to the lengths of tubes constituting the tube body can be controlled in units of clocks for driving delay lines even when digital delay lines such as shift registers are used as the delay lines. According to a method described in U.S. Ser. No. 07/511,217 previously filed and assigned to the present assignee, delay times can be controlled on the order below a decimal point of a unit of the clocks for driving the delay lines. Therefore, a total delay time corresponding to the length of the tube body can be essentially continuously changed, and essentially continuous pitch control can be attained.

In this manner, according to the present invention, a pitch can be controlled at smaller intervals than those in the prior art. In particular, a pitch variation effect such as a vibrato effect can be obtained by a much simpler arrangement than that in the prior art which simulates tone holes of a wind instrument.

In the conventional apparatus, since the respective node portions correspond to tone holes, the node portions (i.e., signal transmission units) corresponding in number to tone holes or more of an acoustic instrument are required. However, according to the present invention, the node portions simulate seams of tubes obtained when a tubular shape is approximated by a combination of some columns. Therefore, the number of node portions, i.e., signal transmission units can be decreased. From this viewpoint, an arrangement can also be simplified.

DETAILED DESCRIPTION OF THE PREFERRED EMBODIMENT

An embodiment of the present invention will be described in detail hereinafter.

Figure 1:
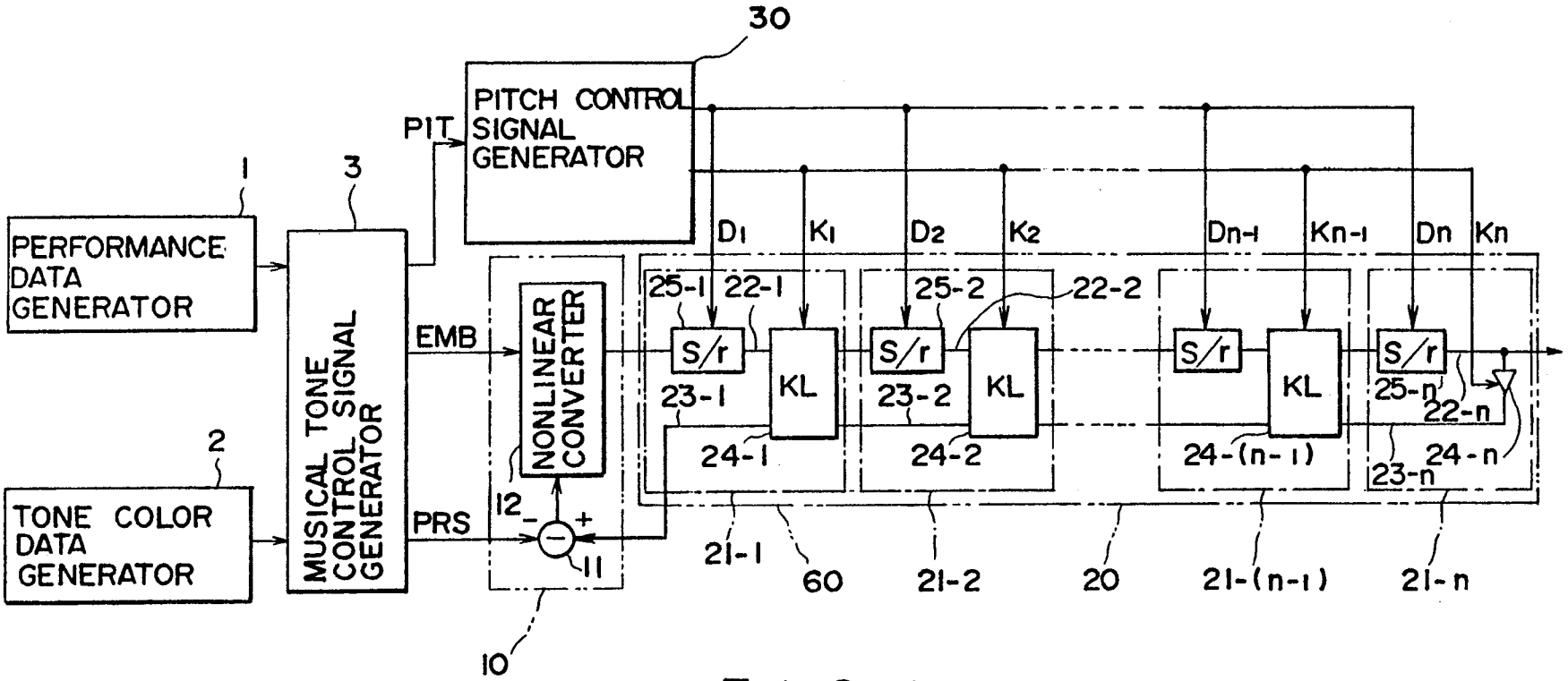
FIG. 1 is a block diagram showing an arrangement of an electronic musical instrument comprising a musical tone waveform forming apparatus according to an embodiment of the present invention.

FIG. 1 shows an arrangement of an electronic musical instrument comprising a musical tone waveform signal forming apparatus according to an embodiment of the present invention.

The electronic musical instrument shown in FIG. 1 supplies a musical tone control signal generated by a musical tone control signal generator 3 on the basis of performance data generated by a performance data generator 1, and musical tone data generated by a tone color data generator 2 to a musical tone waveform signal forming apparatus comprising a musical tone control signal input section 10, a waveform signal transmission section 20, and a pitch control signal generator 30, thereby forming a musical tone waveform signal.

The performance data generator 1 comprises a keyboard consisting of a plurality of keys corresponding to a scale, and various circuits associated with the keyboard, such as a key depression detector for detecting the presence/absence of a depression operation of each key, an initial touch detector for detecting a key depression velocity, an after touch detector for detecting a depression pressure or a depression depth, and the like. The generator 1 outputs performance data such as initial touch data, after touch data, and the like.

The tone color data generator 2 comprises tone color selection switches, and an operation detector for these switches, and outputs tone color data representing a selected tone color.

The musical tone control signal generator 3 comprises, e.g., a microcomputer, a musical tone control parameter table, and the like, and looks up the table in accordance with the performance data and the tone color data, thereby outputting various musical tone control signals which are not time-serially changed, and various other musical tone control signals which are time-serially changed. These musical tone control signals include, e.g., a pitch signal PIT determined by a key depressed at the keyboard, and representing a pitch of a musical tone to be generated, a mouth pressure signal PRS determined by initial touch data, after touch data, and tone color data, and representing a mouth pressure (blowing pressure) during performance of a wind instrument, and an embouchure signal EMB determined by the above-mentioned various performance data, and representing a position and a closing state of lips during performance of the wind instrument.

When a mouth controller comprising a sensor for detecting a breath pressure, or the like is able to be connected to the electronic musical instrument of this embodiment, some performance data may be acquired from the mouth controller. When the present invention is applied to an electronic wind instrument, the various performance data may be obtained from a performance section of the wind instrument. As the performance data generator 1 and the tone color data generator 2, another musical instrument or an automatic performance apparatus may be adopted, so that performance data and tone color data may be supplied from the instrument or apparatus to the musical tone control signal generator 3, or that the various musical tone control signals may be formed in the instrument or apparatus, and may be directly supplied to the musical tone waveform signal forming apparatus comprising the musical tone control signal input section 10, the waveform signal transmission section 20, and the pitch control signal generator 30.

The musical tone control signal input section 10 comprises a subtractor 11, and a nonlinear converter 12. The subtractor 11 subtracts the mouth pressure signal PRS from a waveform signal output from a signal line 23-1 of a signal transmission unit 21-1 serving as the last stage of the backward path of a waveform signal in the waveform signal transmission section 20. The nonlinear converter 12 nonlinearly converts the subtraction result in accordance with predetermined nonlinear characteristics, and outputs the converted result to a signal line 22-1 of the signal transmission unit 21-1 serving as the first stage of the forward path of a waveform signal. The subtraction and nonlinear conversion processing can simulate, e.g., a formation state of an incident wave into a tube body (resonance tube) due to vibration of a reed fixed to an end portion of a mouthpiece of a wind instrument. More specifically, subtraction processing by the subtractor 11 represents a state wherein the reed is displaced according to a differential pressure between a mouth pressure and a reflection wave pressure transmitted from the resonance tube into the mouthpiece, and a conversion circuit of the nonlinear converter 12 represents nonlinear characteristics of bending with respect to a force at the reed, nonlinear characteristics between an air flow and an air pressure passing through the mouthpiece, and the like. The nonlinear converter 12 receives the embouchure signal EMB, and the basic nonlinear conversion characteristics are corrected in accordance with the signal EMB. Note that the subtractor 11 may be equivalently constituted by an adder in consideration of the mouth pressure signal PRS and the positive or the negative sign of a waveform signal from a signal line 23.

The waveform signal transmission section 20 comprises a plurality of waveform signal transmission units 21 (21-1, 21-2, . . . , 21-n) which are connected in cascade connection one by one. Each waveform signal transmission unit 21 comprises a signal line 22 (22-1, 22-2, . . . , 22-n) serving as the forward path of a waveform signal, a signal line 23 (23-1, 23-2, . . . , 23-n) serving as the backward path of a waveform signal, and a node portion 24 (24-1, 24-2, . . . , 24-n) for feeding back an output from the signal line 22 to an input side of the signal line 23. In the signal line 22, shift registers 25

(25-1, 25-2, . . . , 25-n) serving as delay circuits are serially connected. The node portion 24-n comprises a multiplier, and other node portions 24-1 to 24-(n−1) comprise digital filters shown in FIG. 2 (Kelly•Rohobaum's lattice structure filters).

Figure 2:
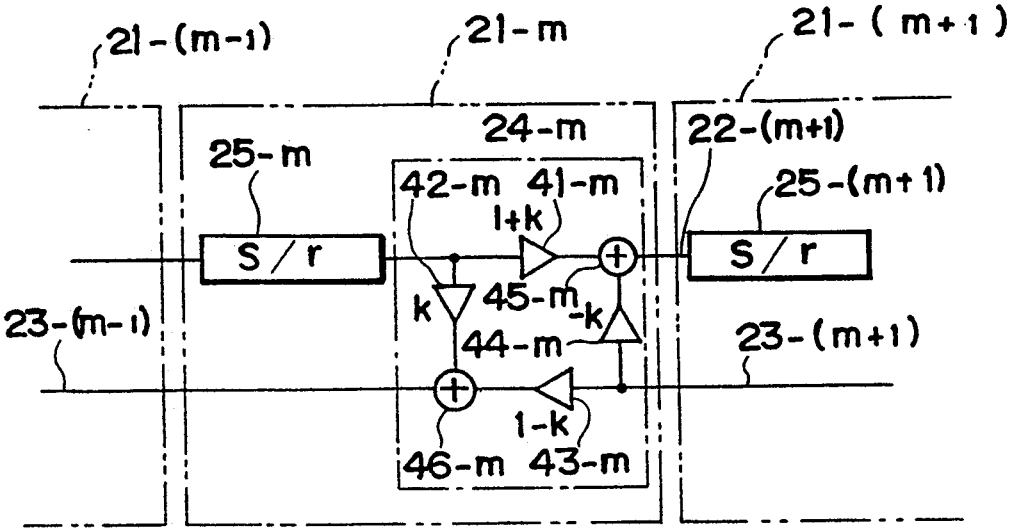
FIG. 2 is a block diagram showing an arrangement of a lattice filter as an embodiment of a node portion in FIG. 1.

A lattice structure filter 24-m shown in FIG. 2 comprises multipliers 41-m, 42-m, 43-m, and 44-m, and adders 45-m, and 46-m. The multiplier 41-m and the adder 45-m are serially inserted in a signal line 22-m together with a delay circuit 25-m, and the multiplier 41-m multiplies a waveform signal output (data value) from the delay circuit 25-m with (1+k) and supplies the product to one input terminal of the adder 45-m. The multiplier 42-m multiplies a waveform signal output from the delay circuit 25-m with k, and supplies the product to one input terminal of the adder 46-m. The multiplier 43-m and the adder 46-m are inserted in a signal line 23-m, and the multiplier 43-m multiplies a waveform signal output generated from a signal line 23-(m+1) of the next signal transmission unit 21-(m+1) with (1−k), and supplies the product to the other input terminal of the adder 46-m. The multiplier 44-m multiplies a waveform signal output from the signal line 23-(m+1) with −k, and supplies the product to the other input terminal of the adder 45-m. The adder 45-m adds the outputs from the multipliers 41-m and 44-m, and supplies the sum as the output from the signal line 22-m to a signal line 22-(m+1) of the next signal transmission unit 21-(m+1). The adder 46-m adds the outputs from the multipliers 42-m and 43-m, and supplies the sum to a signal line 23-(m−1) of an immediately preceding signal transmission unit 21-(m−1) via the signal line 23-m.

Figure 3:
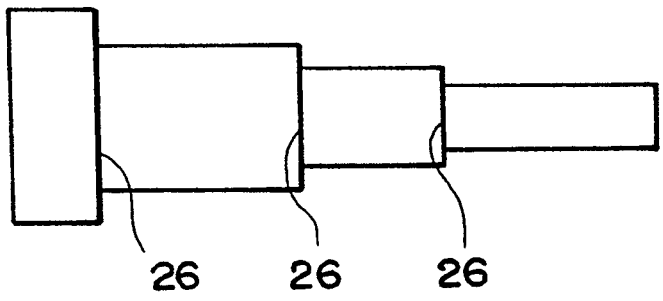
FIG. 3 is a side view showing a tubular shape of a wind instrument simulated by the arrangement shown in FIGS. 1 and 2.

With this arrangement, in the waveform signal transmission section 20 shown in FIG. 1, each waveform signal transmission unit 21 can simulate a cylindrical tube having a length corresponding to a delay time of its delay circuit 25, and having a sectional area corresponding to a coefficient k of its node portion 24, and the waveform signal transmission section 20 as a whole can simulate a resonance tube shown in FIG. 3 obtained by serially connecting the plurality of cylindrical tubes.

In FIG. 3, if the sectional areas of cylindrical tubes on the left and right sides of a seam 26 of the cylindrical tubes are represented by ; and r, the multiplication coefficient k of the lattice structure filter 24 shown in FIGS. 1 and 2 is given by:

$$k = \frac{l - r}{l + r}$$

A wind instrument simulated by the musical tone waveform signal forming apparatus shown in FIG. 1 does not have tone holes. In order to control a pitch, delay lengths corresponding to the respective cylindrical tubes are changed. In order to attain fine pitch control, a delay length (delay time) of at least one of some cylindrical tubes can be interpolated. As a method of interpolating a digital delay length, a method described in U.S. Ser. No. 07/511,217 previously filed and assigned by the present applicant can be presented.

In FIG. 1, the pitch control signal generator 30 receives the pitch signal PIT of musical tone control signals generated by the musical tone control signal generator 3 on the basis of performance data generated by the performance data generator 1 and musical tone data generated by the tone color data generator 2, and generates pitch control signals D1, D2, . . . , Dn on the basis of the input pitch signal PIT. These pitch control signals D1, D2, . . . , Dn are supplied to the delay circuits 25 of the respective waveform signal transmission units 21 as signals for controlling delay times (the number of shift registers and a delay length to be interpolated) of the corresponding delay circuits 25. The pitch control signal generator 30 may comprise a conversion table which is a memory storing data (e.g., data each representing the number of stages of each delay and the interpolation length) corresponding to key codes (pitch data) generated by the performance data generator 1, and can convert the key codes into pitch control data. In order to finely control a pitch by one delay length or less, a delay length of at least one of the signal transmission units corresponding to the cylindrical tubes need only be linearly interpolated. For example, a delay length at the mouthpiece side (signal transmission unit 21-1) or a delay length at an open end of a tube (signal transmission unit 21-n) is linearly interpolated.

As is well known, a saxophone can produce its tone color even if its tube is cut at a middle portion. I order to keep similar tone colors at different intervals, a flared tube body (resonance tube) must be kept with a similar shape. When the coefficient k of the lattice structure filter is appropriately changed together with the delay length, the shape of the tube body can be kept with a similar shape.

A case will be described below wherein the coefficient k of the lattice structure filter is kept constant, and another case will then be described wherein the coefficient k of the lattice structure filter is appropriately changed.

The coefficient k of the Kelly•Rohobaum's lattice structure filter can be expressed as follows based on the sectional areas of two adjacent cylindrical tubes, as described above:

$$k = \frac{l - r}{l + r}$$

When the coefficient k representing the sectional areas of the two adjacent cylindrical tubes is left unchanged, if a pitch becomes high, and the tube length becomes short, a conical resonance tube approximated by serially connecting a plurality of these cylindrical tubes has a shape collapsed in the longitudinal direction. This implies that the shape of the tube body (resonance tube) is changed according to the pitch. When a conical tube is approximated by a plurality of cylindrical tubes, in order to keep a constant relative shape of the tube, all the coefficients k must be changed every time the tube length is changed. However, when the coefficient k is left unchanged, the relative shape is changed, and a tone which has a feature similar to that of a wind instrument but is slightly changed can be generated. This can provide an effect in which as a tone of a saxophone becomes higher, a tube shape is approximate to a megaphone.

In order to keep similar tone colors at different intervals, a flared tube body (resonance tube) must be kept with a similar shape. In order to achieve this, all the coefficients k representing the sectional areas of the two adjacent cylindrical tubes must be changed.

For this purpose, data of the coefficients k (k−1, k−2, . . . , k−n) of the Kelly•Rohobaum's lattice filters can be prepared together with the delay length data corresponding to key codes. Various methods of obtaining coefficients k for keeping a similar shape of the tube body may be proposed depending on the shape of the tube body, the ratio of delay lengths, and the like. When the tube body has a conical shape, and the ratio of delay lengths is constant, since the diameters of the cylindrical tubes can be proportionally obtained, their areas can be obtained. Therefore, the coefficients k can be easily obtained. Even when the tubes have complex shapes, if their diameters are obtained in accordance with an expanded or contracted tube length, the coefficients k can be easily obtained.

Modification of Embodiment

The present invention is not limited to the above embodiment, and various changes and modification may be made.

For example, when the coefficient k is set to be constant, a pitch may be controlled by changing only a specific portion like in a trombone. In this case, an effect of changing a pitch by expanding or contracting the same portion can be obtained.

In the above embodiment, a case wherein the coefficient k is kept constant and a case wherein the coefficient k is changed in correspondence with the delay length so that the tube body can keep a similar shape even if the delay length is changed have been described. Alternatively, the coefficient k may be changed in correspondence with the delay length, so that the tube body does not keep a similar shape, thereby obtaining an effect according to setting.

What is claimed is:

1. A musical tone waveform signal forming apparatus comprising:

waveform signal transmission means including a plurality of signal transmission units which are connected in cascade one by one and each of which comprises a first signal line serving as a forward path of a waveform signal, a second signal line serving as a backward path of said waveform signal, and a node position for feeding back an output from said first signal line to an input side of said second signal line at least one of said first and second signal lines serving as a signal delay line;

musical tone control signal generating means for receiving performance information and for generating plural musical tone control signals;

musical tone control signal input means for receiving said waveform signal from said waveform signal transmission means, and receiving musical tone control signals from said musical tone control signal generating means for controlling musical tone parameters of a musical tone to be generated, and for changing the waveform signal in accordance with the musical tone control signals, and for outputting the changed waveform signal to said forward path of said waveform signal transmission means; and pitch control means for changing delay times of said signal delay lines in accordance with a musical tone control pitch signal from said musical tone control signal generating means for controlling tone pitch.

2. An apparatus according to claim 1, wherein said node portions of said waveform signal transmission means have feedback coefficients which are kept constant regardless of a change in delay time.

3. An apparatus according to claim 1, wherein said node portions of said waveform signal transmission means have feedback coefficients which are corrected in correspondence with a change in delay time.

4. An apparatus according to claim 1, wherein said musical tone control signal input means comprises pitch control signal generation means, which generates a pitch control signal forwarded to said pitch control signal generator, said pitch control signal generator having a conversion table therein, and converts said pitch signal into a pitch control signal according to said conversion table, said pitch control signal being supplied to said signal delay lines.

5. An apparatus according to claim 2, wherein said pitch control means controls at least one of said delay times of the signal delay lines of the signal transmission units in accordance with said musical tone control pitch signal.

6. An apparatus according to claim 3, wherein said pitch control means uniformly changes each of said delay times of the signal delay lines of said signal transmission units in accordance with said musical tone control pitch signal.

* * * * *